US009725100B2

(12) United States Patent
Early

(10) Patent No.: US 9,725,100 B2
(45) Date of Patent: Aug. 8, 2017

(54) HATCH COVER MOUNTED LATCH FOR A RAILCAR

(71) Applicant: AERO TRANSPORTATION PRODUCTS, INC., Independence, MO (US)

(72) Inventor: Stephen R. Early, Olathe, KS (US)

(73) Assignee: AERO TRANSPORTATION PRODUCTS, INC., Independence, MO (US)

( * ) Notice: Subject to any disclaimer, the term of this patent is extended or adjusted under 35 U.S.C. 154(b) by 390 days.

(21) Appl. No.: 14/565,935

(22) Filed: Dec. 10, 2014

(65) Prior Publication Data

US 2016/0167680 A1 Jun. 16, 2016

(51) Int. Cl.
*B61D 7/16* (2006.01)
*B61D 7/00* (2006.01)

(52) U.S. Cl.
CPC *B61D 7/16* (2013.01); *B61D 7/00* (2013.01)

(58) Field of Classification Search
CPC .... B61D 17/16; Y10T 292/202; Y10T 16/528
USPC ..... 105/377.05, 377.07
See application file for complete search history.

(56) References Cited

U.S. PATENT DOCUMENTS 2,599,072 A 6/1952 Schweiso
2,679,418 A * 5/1954 Cisco ..... B61D 17/16 292/100
2,679,419 A * 5/1954 Borland ..... B63B 19/24 105/377.11
3,844,597 A 10/1974 Elrod et al.
4,000,703 A * 1/1977 Halliar ..... F16J 13/18 105/377.11
4,046,082 A 9/1977 Tedesco et al.
4,234,221 A 11/1980 Przybylinski et al.
4,570,816 A * 2/1986 Ferris ..... B65D 90/10 105/308.2
4,613,174 A * 9/1986 Berg ..... B61D 9/12 105/377.05
4,635,979 A 1/1987 Blume
4,739,896 A 4/1988 Moss
5,197,226 A 3/1993 Gayhart et al.
(Continued)

OTHER PUBLICATIONS

Aero Transportation Products, Inc., Latch Shown in Ex. A, sold by Aero Transportation Products, Inc. prior to Dec. 10, 2013.

*Primary Examiner* — Zachary Kuhfuss
(74) *Attorney, Agent, or Firm* — Stinson Leonard Street LLP

(57) ABSTRACT

A railcar hatch cover assembly having a cover, a latch engaging structure, a latch coupled to the cover, and a handle coupled to the latch. The handle is configured to be grasped by an operator. When a substantially vertical force is applied to the handle, it moves the latch from a latched position to an unlatched position and moves the cover from a closed position to an open position. When the cover is dropped from the open position to the closed position, the latch contacts the latch engaging structure and moves from the unlatched position to the latched position. A railcar latch assembly having a latch coupled to the cover and a handle coupled to the latch. The latch has an arcuate bottom surface that contacts the latch engaging structure to move the latch from an unlatched position to a latched position.

17 Claims, 9 Drawing Sheets

(56) References Cited

U.S. PATENT DOCUMENTS

| | | | | |
|---|---|---|---|---|
| 5,314,218 | A * | 5/1994 | Nadherny | B63B 19/24 292/11 |
| 5,517,925 | A * | 5/1996 | Early | F16J 13/18 105/377.07 |
| 5,697,121 | A | 12/1997 | Early | |
| 5,785,362 | A * | 7/1998 | Nadherny | B61D 7/24 105/377.11 |
| 6,039,362 | A | 3/2000 | Nadherny | |
| 6,092,471 | A | 7/2000 | Early | |
| 7,360,801 | B2 | 4/2008 | Breslin et al. | |
| 8,448,385 | B2 | 5/2013 | Brewster et al. | |
| 2009/0158959 | A1 | 6/2009 | Schultz et al. | |
| 2010/0084876 | A1* | 4/2010 | Helms | E05B 13/002 292/256.5 |

* cited by examiner

HATCH COVER MOUNTED LATCH FOR A RAILCAR

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention is directed toward a railcar latch assembly and, in particular, to a railcar latch assembly adapted for use with a railcar hatch cover.

2. Description of Related Art

Covered hopper railcars have been used for years to transport particulate and granular materials such as grain. Typically, a car is loaded or unloaded through the use of overhead chutes that extend through one or more openings in the top of the car. One or more covers are typically mounted to the top of the car. The covers rotate from a closed position covering the opening and protecting any cargo stored within the railcar to an open position for loading and/or unloading. In order to prevent the covers from inadvertently opening while the railcar is in transport, a latch is typically mounted to the top of the railcar.

One type of conventional latch is manufactured by IRECO. In a latched position, the latch engages a tab on the cover to prevent it from opening. The latch is moveable from the latched position to an unlatched position by rotating it about an axis that is perpendicular to the direction of movement of the railcar. The latch has a locking pawl that must be released before the latch may be rotated to its unlatched position. A seal may be inserted through openings in the latch to provide an indication of whether the cover has been opened.

In order to open the cover, a railroad worker standing on top of the railcar must perform the following sequence: (1) cut the seal; (2) remove the seal; (3) release and hold the locking pawl; (4) rotate the latch to unlatch it; and (5) grasp the lower edge of the cover and rotate it to the open position. Thus, the worker must perform five separate steps to open the cover. The majority of these steps must be repeated in reverse in order to close and latch the cover. There may be five or more covers on a railcar and fifty or more connected railcars that need to be loaded and unloaded. Repeating these steps for the opening and closing of each cover on each railcar takes a substantial amount of time. Further, it can be dangerous to perform all of these steps while standing on a relatively narrow walkway on top of the railcar.

BRIEF SUMMARY OF THE INVENTION

The present invention is directed in one aspect to a railcar latch assembly including a latch engaging structure adapted to be mounted to a railcar and a handle and latch assembly adapted to be mounted to a cover of the railcar. The handle and latch assembly includes a latch and a handle that is coupled to the latch. The handle is configured to be grasped by an operator so that when the operator applies a substantially vertical force to the handle, simultaneously 1) the latch moves from a latched position, in which the latch engages the latch engaging structure, to an unlatched position, and 2) the railcar cover moves from a closed position to an open position. The operator may drop the cover from the open position to cause the latch to engage the latch engaging structure such that the latch automatically moves from the unlatched position to the latched position as the cover closes. Thus, only a single step is required to unlatch the latch and open the cover, and a single step is required to close the cover and move the latch to the latched position.

The latch preferably has a substantially planar upper surface that engages the latch engaging structure when the latch is in the latched position. The bottom surface of the latch is preferably arcuate and contacts the latch engaging structure when the cover is dropped from the open position to the closed position. The bottom surface is configured so that as it contacts the latch engaging structure it causes the handle and latch assembly to rotate upward. Once the arcuate bottom surface of the latch clears the latch engaging structure, the handle and latch assembly rotates downward, which in turn causes the upper surface of the latch to engage the latch engaging structure. Preferably, the latch and the cover each have a tab, and each tab has an opening. When the latch is in the latched position, the openings in the tabs are aligned such that a seal may be threaded through the aligned openings. Once the seal is in place, moving the latch from the latched position to the unlatched position shears the seal.

The present invention is also directed to a railcar hatch cover assembly including a railcar cover in addition to the latch engaging structure and handle and latch assembly set forth above. The cover may be any type of cover, including a hatch cover, port cover, or batten bar.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

DETAILED DESCRIPTION OF PREFERRED EMBODIMENT

Figure 1:
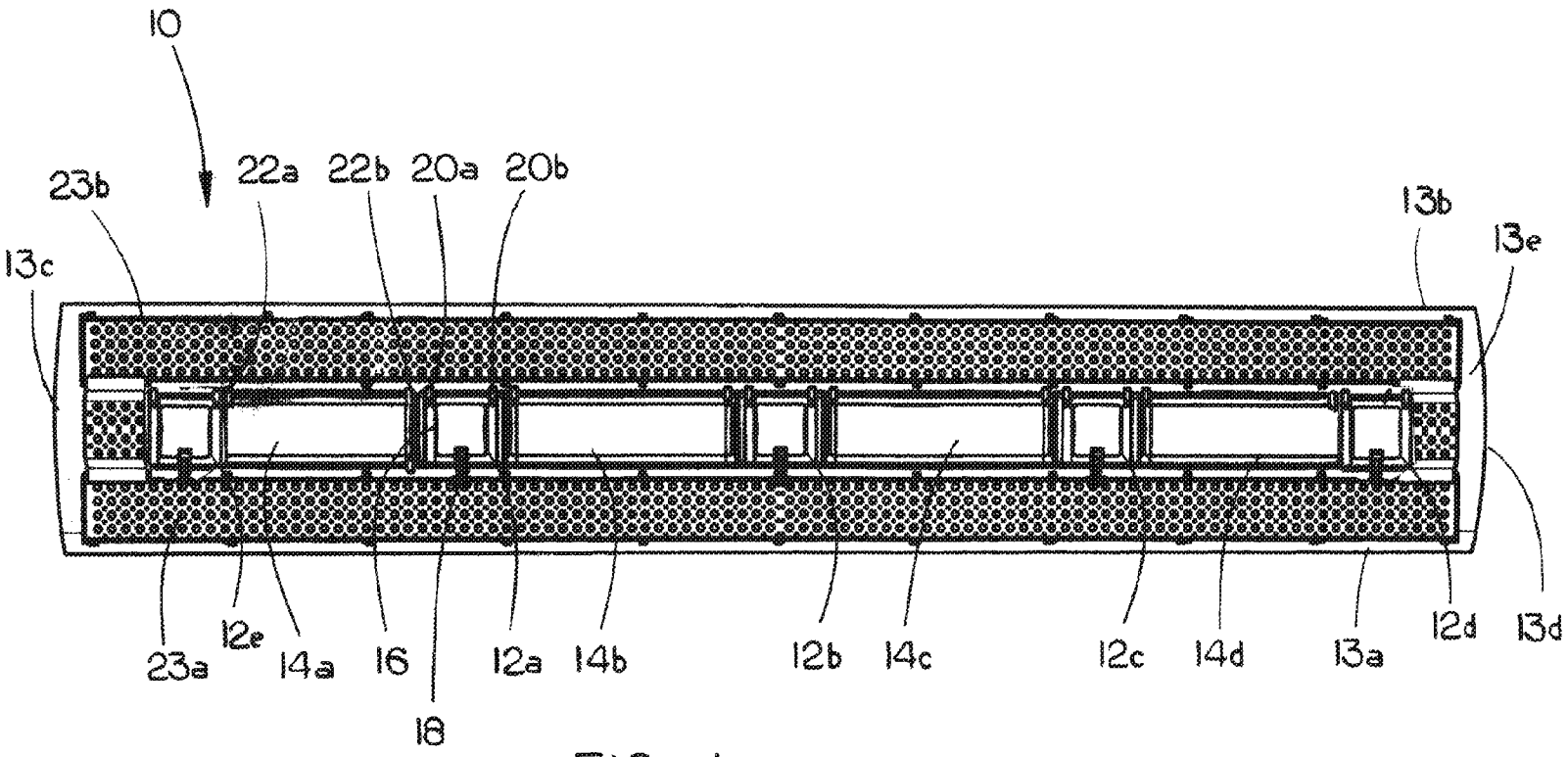
FIG. 1 is a top plan view of a railcar to which is mounted five railcar hatch cover assemblies in accordance with the present invention, each including a cover that overlaps at least one end of an adjacent larger cover.

Referring to FIG. 1, mounted to a railcar 10 are five railcar hatch cover assemblies in accordance with the present invention that are generally identified as 12*a*, 12*b*, 12*c*, 12*d*, and 12*e*. Railcar 10 includes side walls 13*a* and 13*b* extending parallel to a longitudinal axis of the railcar 10, end walls 13*c* and 13*d* joined to each of the side walls 13*a* and 13*b*, and a top 13*e* including an access opening 13*f* (FIG. 4) that, as shown in FIG. 1, is covered by railcar hatch cover assemblies 12*a-e* and covers 14*a-d*.

Each of railcar hatch cover assemblies 12*a-e* is substantially identical. Accordingly, only railcar hatch cover assembly 12*a* is described in detail herein. Railcar hatch cover assembly 12*a* includes a cover 16 and a railcar latch assembly 18. Cover 16 is rotatably mounted to railcar 10 with hinges 20*a* and 20*b*. Each of covers 14*a-d* is also mounted to railcar 10 with a pair of hinges, two of which for cover 14*a* are identified as 22*a* and 22*b*. Walkways 23*a* and 23*b* are mounted to the top 13*e* of railcar 10 on either side of hatch cover assemblies 12*a-e* and covers 14*a-d*. When in the closed position shown in FIG. 1, cover 16 overlaps the edges of adjacent covers 14*a* and 14*b*, the cover of hatch cover assembly 12*b* overlaps the edges of adjacent covers 14*b* and 14*c*, the cover of hatch cover assembly 12*c* overlaps the edges of adjacent covers 14*c* and 14*d*, the cover of hatch cover assembly 12*d* overlaps an edge of cover 14*d*, and the cover of hatch cover assembly 12*e* overlaps an edge of cover 14*a*. Accordingly, prior to opening cover 14*a*, hatch cover assemblies 12*a* and 12*e* must be opened. Prior to opening cover 14*b*, hatch cover assemblies 12*a* and 12*b* must be opened. Hatch cover assemblies 12*b* and 12*c* must be opened before opening cover 14*c*, and hatch cover assemblies 12*c* and 12*d* must be opened before opening cover 14*d*. Covers 14*a-d* and 16 are rotatable from the closed position shown in FIG. 1 approximately 180 degrees to an open position in which the top surface of the covers 14*a-d* and 16 abuts walkway 23*b*. In the closed position, the covers 14*a-d* and hatch cover assemblies 12*a-e* cover opening 13*f* (FIG. 4) in the top of railcar 10, and in the open position, the covers 14*a-d* and hatch cover assemblies 12*a-e* permit access to the interior of railcar 10 through opening 13*f*.

Figure 3:
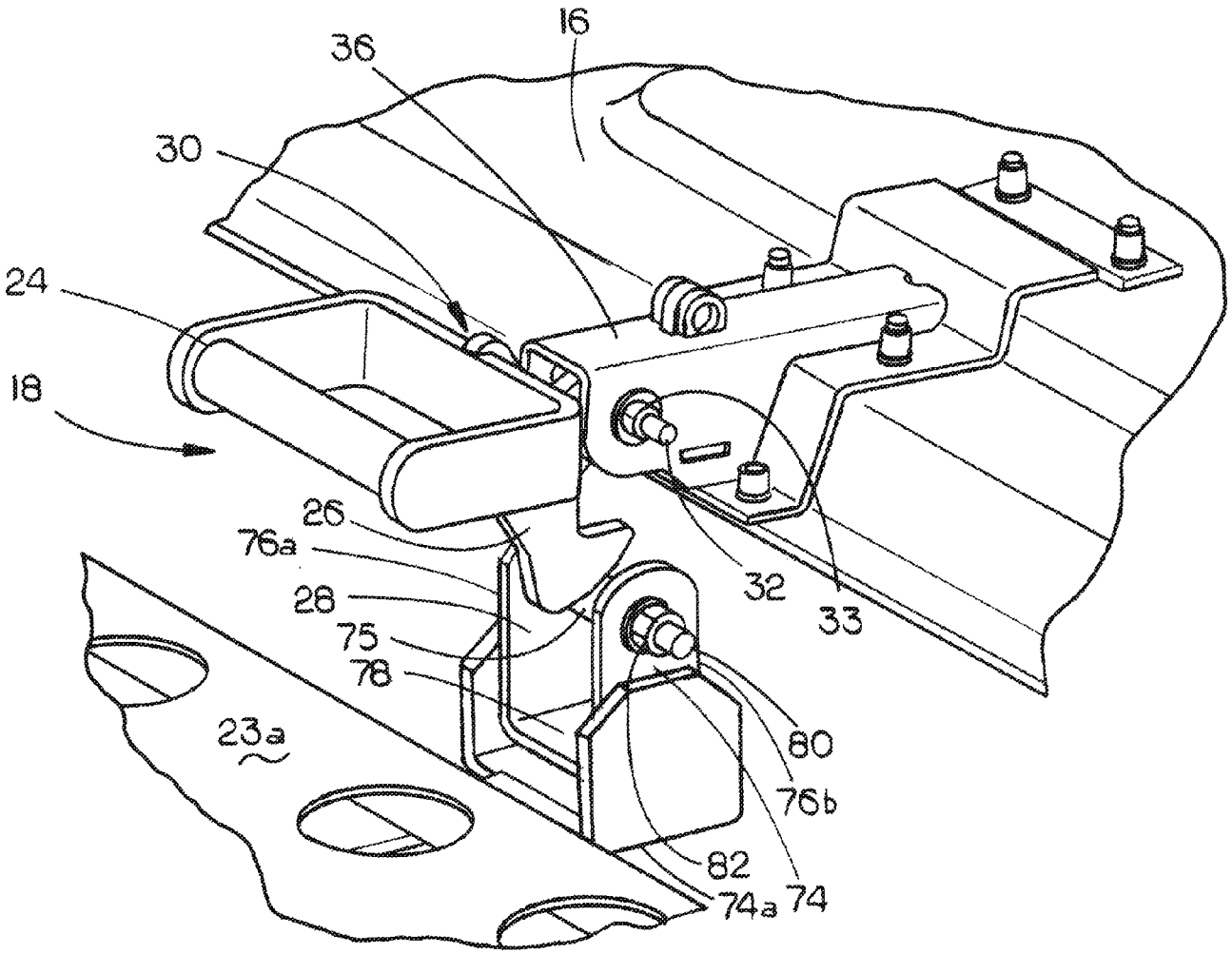
FIG. 3 is a perspective view of a portion of the railcar hatch cover assembly of FIG. 2 showing the latch in an unlatched position.

As shown in FIG. 3, railcar latch assembly 18 includes a handle 24, a latch 26, and a latch engaging structure 28 that is mounted to the top 13*e* (FIG. 1) of railcar 10. Handle 24 is coupled to latch 26 to form a handle and latch assembly 30. Handle and latch assembly 30 is rotatably mounted to cover 16 with a bolt 32 that engages a nut 33. A pivot axis of handle and latch assembly 30 is aligned with bolt 32 and is parallel to the longitudinal axis of railcar 10. The pivot axis of handle and latch assembly 30 is also aligned with the direction of movement of railcar 10, which assists in preventing inadvertent rotation of handle and latch assembly 30 caused by impacts to the ends of railcar 10 in a direction aligned with the longitudinal axis of railcar 10. Latch engaging structure 28 is positioned below bolt 32 when latch 26 is in the latched position shown in FIG. 4.

Figure 2:
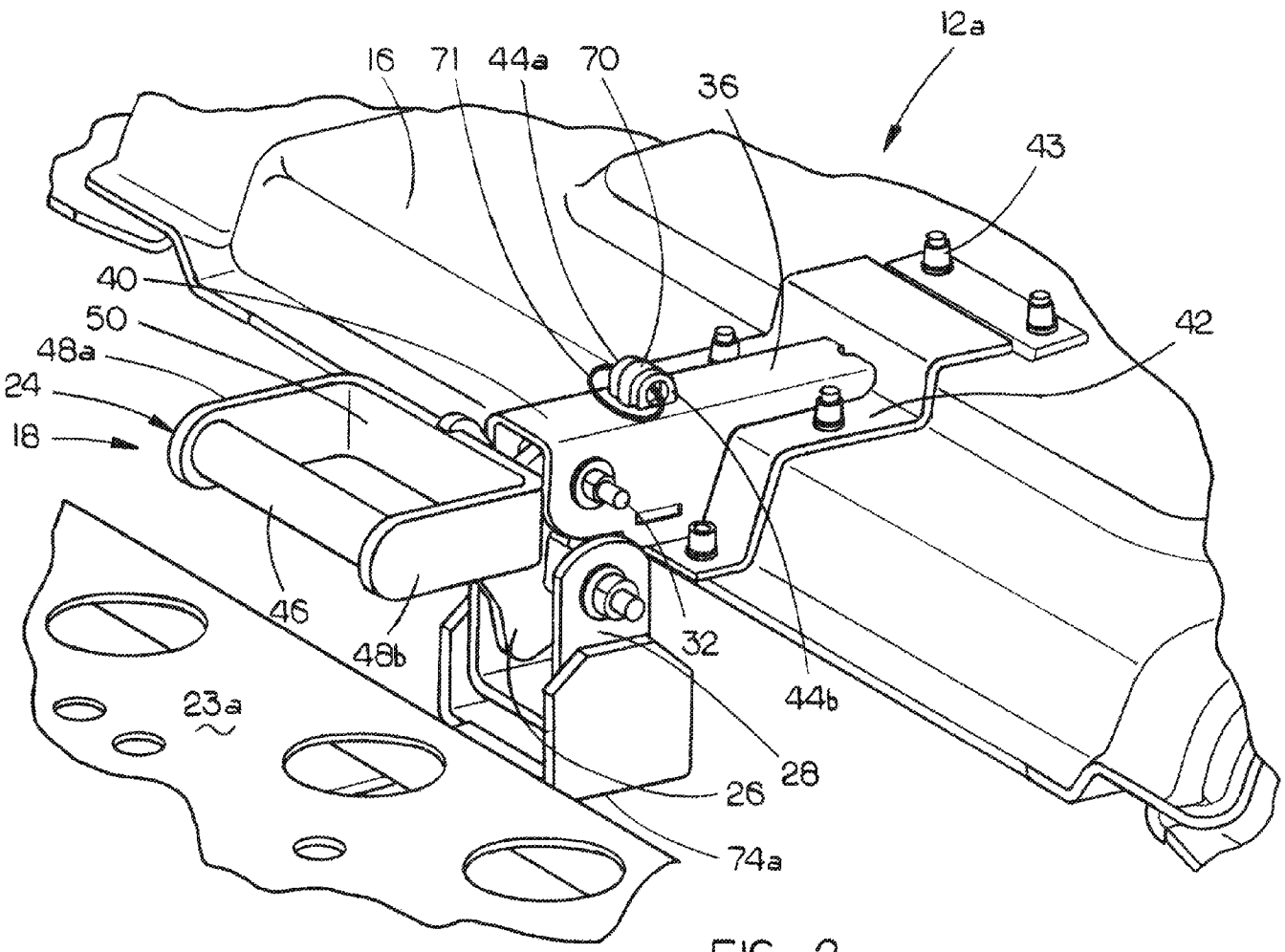
FIG. 2 is a perspective view of a portion of one of the railcar hatch cover assemblies of FIG. 1 showing a latch in a latched position.

Referring to FIG. 2, a bracket 36 is mounted to a top surface of cover 16. Bracket 36 includes an inverted U-shaped section 40 and a mounting plate 42 that is joined to or integral with a lower edge of U-shaped section 40. As depicted, mounting plate 42 generally has the same shape and contour as the top surface of cover 16 such that it is generally flush with cover 16. Mounting panel 42 is secured to cover 16 with a plurality of fasteners, one of which is shown as 43, which may be bolts or rivets. It is within the scope of the invention for bracket 36 to be formed integrally with cover 16 or secured to cover 16 in any manner. Bracket 36 extends laterally outward from a peripheral edge of cover 16 toward latch engaging structure 28.

Figure 4:
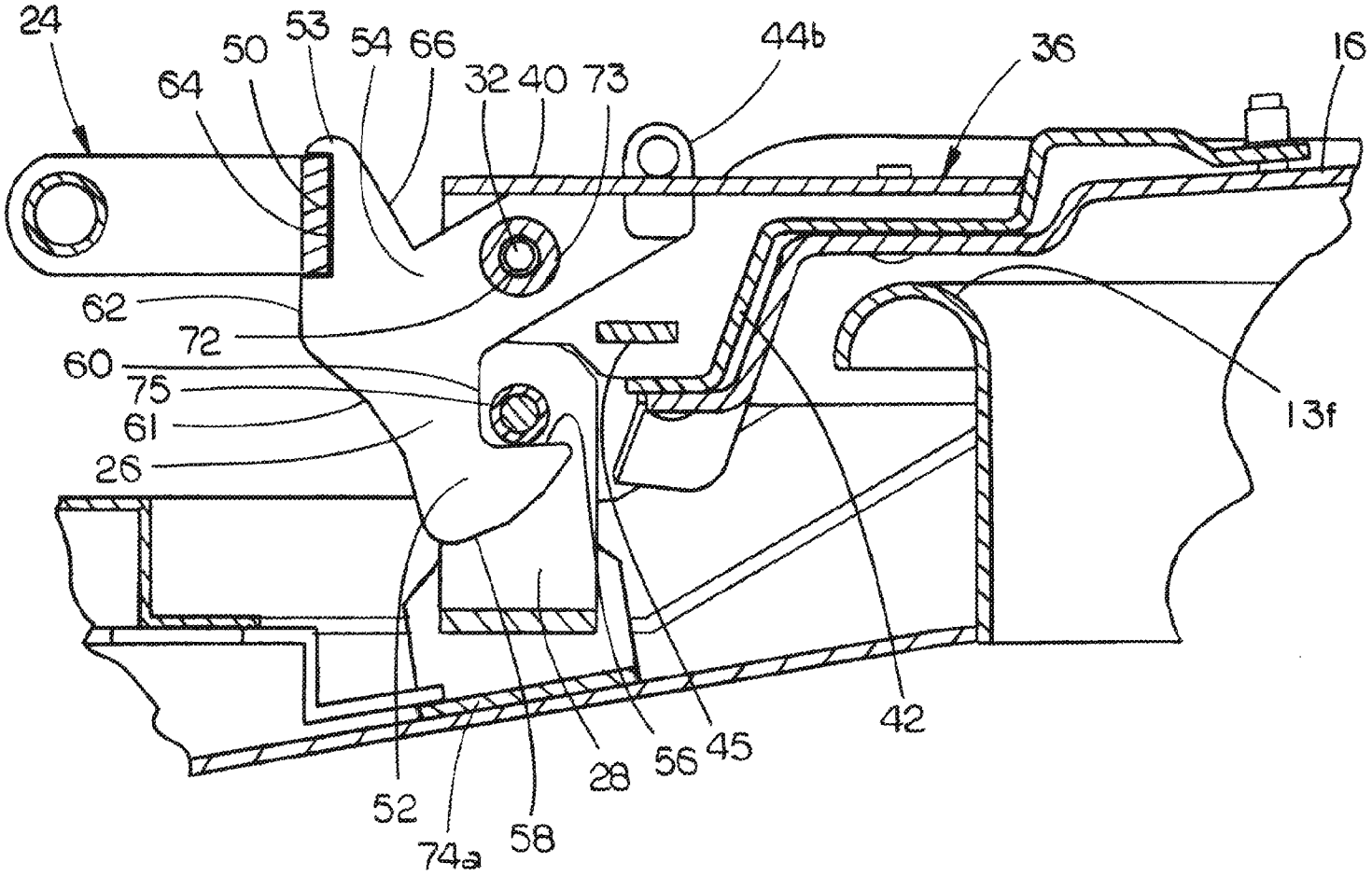
FIG. 4 is a cross-sectional side view of a portion of the railcar hatch cover assembly of FIG. 2 showing the latch in the latched position.

Bolt 32 extends through aligned openings (not shown) in bracket 36 and handle and latch assembly 30 to rotatably mount handle and latch assembly 30 to cover 16. Tabs 44*a* and 44*b* are mounted to an upper surface of bracket 36. The tabs 44*a* and 44*b* are spaced apart, and there is a slot (not shown) formed in the upper surface of bracket 36 between the tabs 44*a* and 44*b*. The slot receives a tab 70 of latch 26 when latch 26 is in the latched position as described in more detail below. The tabs 44*a* and 44*b* have aligned openings, which align with an opening in tab 70 when latch 26 is in the latched position. As shown in FIG. 4, bracket 36 includes a generally horizontal stop plate 45 that extends between and is secured to sides of U-shaped section 40. Stop plate 45 limits the rotation of handle 24 and latch 26 as described in more detail below.

Figure 7:
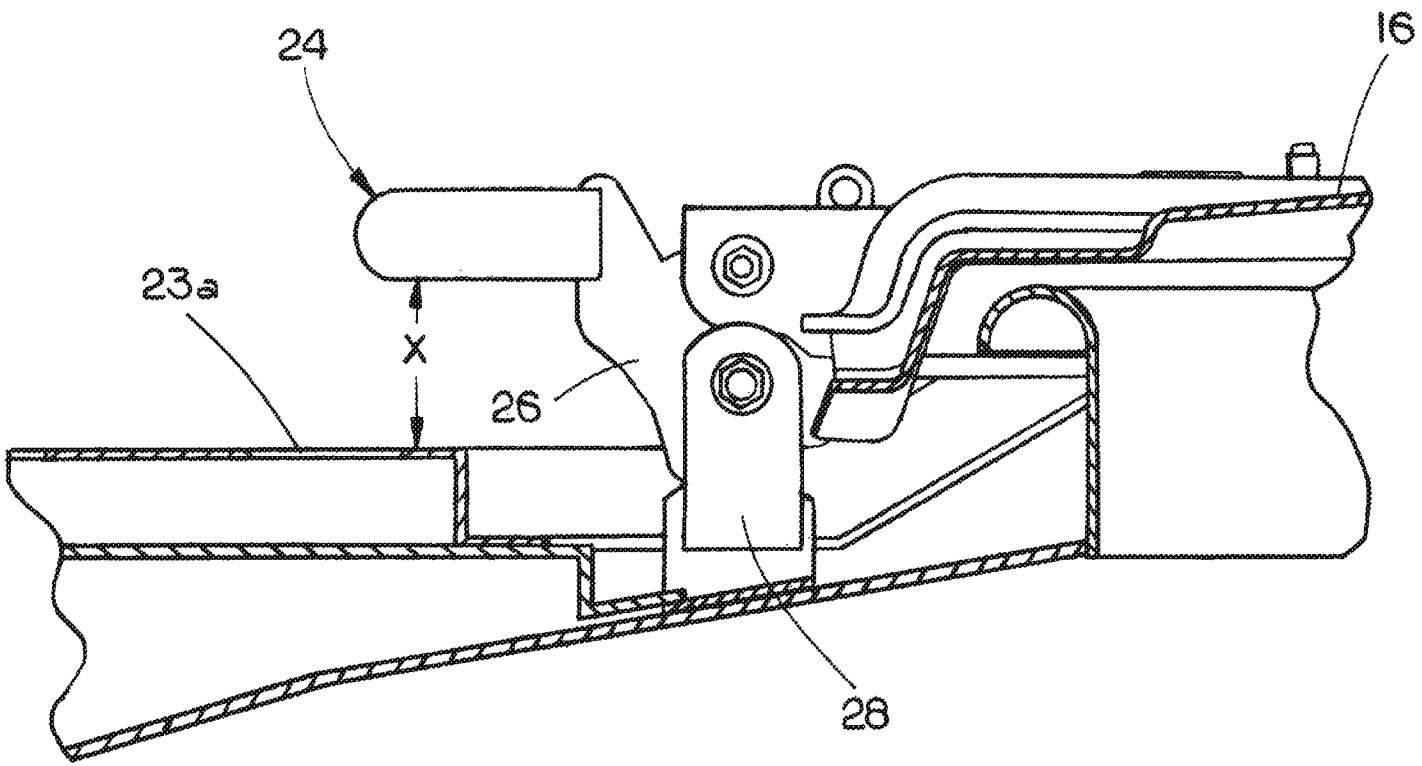
FIG. 7 is a side view of a portion of the railcar hatch cover assembly of FIG. 2 showing the latch in the latched position.

Referring to FIG. 2, handle 24 is generally D-shaped and includes a bar 46 extending between and joined to ends of plates 48*a* and 48*b*, the other ends of which are joined with an end plate 50. Plates 48*a-b* are generally parallel to one another and generally perpendicular to bar 46 and plate 50. Plate 50 is generally parallel to bar 46. Bar 46 is aligned with the longitudinal axis of railcar 10 and the pivot axis of handle and latch assembly 30. As depicted, bar 46 has a circular cross section such that it is cylindrical. However, it is within the scope of the present invention for bar 46 to have any cross section, including but not limited to square, rectangle or oval. Plates 48*a-b* and 50 are preferably integral with each other. Bar 46 is preferably welded to plates 48*a-b*, but it is within the scope of the invention for bar 46 to be joined to plates 48*a-b* in any manner. Bar 46 is spaced apart from plate 50 and sized so that an operator positioned on walkway 23*a* may grasp bar 46 with his/her hand such that a portion of the operator's fingers would be positioned within the space surrounded by plates 48*a-b* and 50. When railcar latch assembly 18 is in the latched position shown in FIG. 2, handle 24 is oriented so that it is substantially horizontal and extends laterally from the pivot axis of handle and latch assembly 30. As shown in FIG. 7, the bottom of handle 24 is positioned a distance X above the top surface of walkway 23*a*. The distance X is preferably at least two inches if the handle 24 is directly above the walkway 23*a*.

Latch 26, shown in FIG. 4, includes a hook 52, a handle mounting portion 53 extending upward from one side of hook 52, and a rotating arm 54 extending upward from the other side of hook 52. Hook 52, handle mounting portion 53, and rotating arm 54 are formed from a planar sheet of material having a generally uniform thickness. Hook 52 includes a substantially planar upper surface 56, which is generally horizontal when latch 26 is in the latched position shown in FIG. 4, an arcuate bottom surface 58 extending downward from upper surface 56, a vertical first side 60 extending upward from upper surface 56 to arm 54, and an arcuate second side 61 extending upward from bottom surface 58 to handle mounting portion 53.

Handle mounting portion 53 includes a vertical side wall 62 extending upward from arcuate second side 61. A notch 64 is formed in side wall 62 for receiving plate 50 of handle 24. Handle 24 is preferably joined to latch 26 via welding, but it is within the scope of the invention for handle 24 and latch 26 to be joined by any means known in the art. Further, handle 24 and latch 26 may be integrally formed from a single piece of material. For example, handle 24 and latch 26 may be cast as one piece. A sloped side 66 extends downward from side wall 62 to rotating arm 54.

Figure 5:
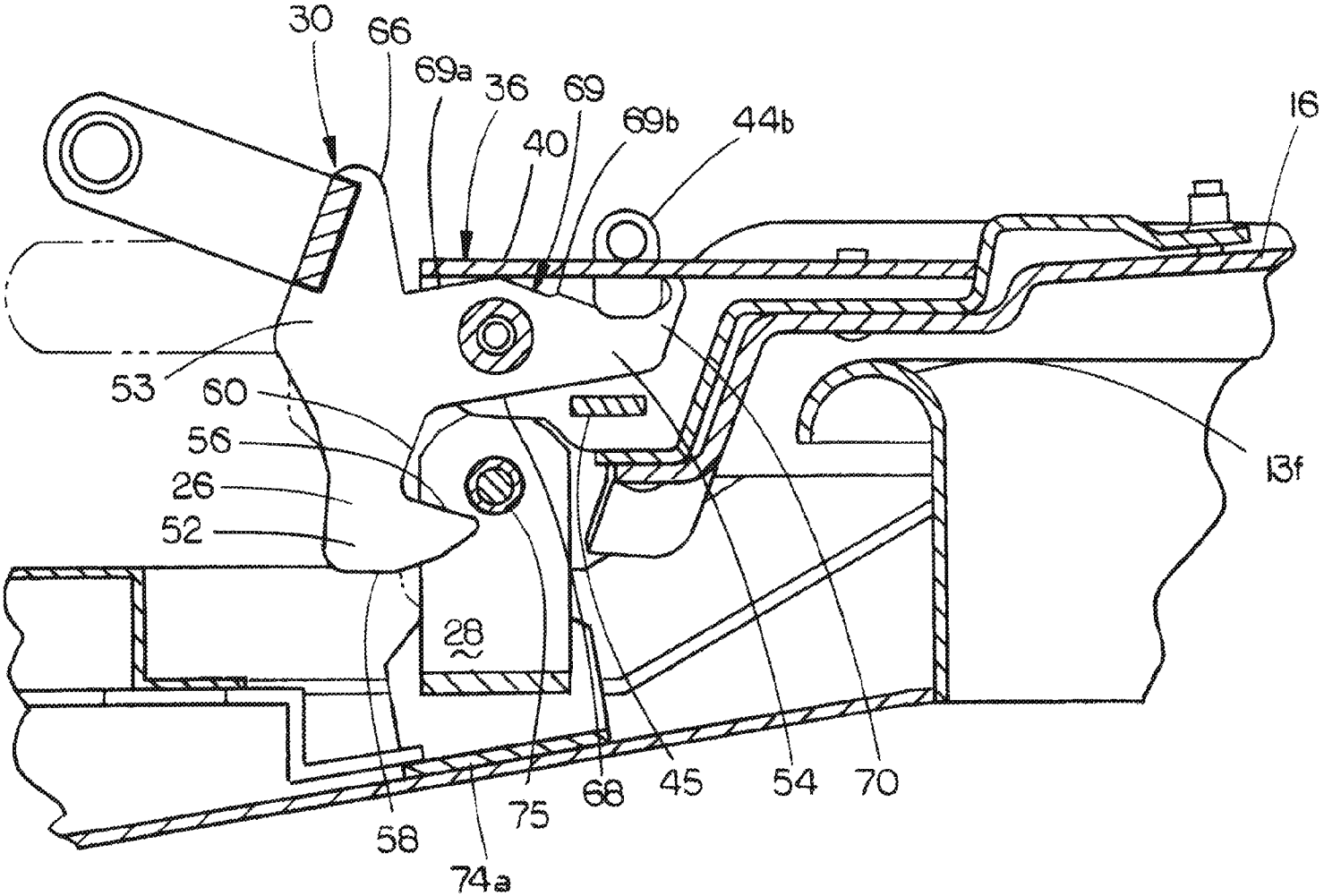
FIG. 5 is a cross-sectional side view similar to FIG. 4 showing the latch in an unlatched position.

As shown in FIG. 5, rotating arm 54 includes a lower surface 68 extending upward and outward from first side 60 of hook 52, and an upper surface 69 with a first portion 69*a* that extends upward from sloped side 66 of handle mounting portion 53 and a second portion 69*b* extending at an angle outward from first portion 69*a*. First portion 69*a* of upper surface 69 is generally parallel with lower surface 68, and second portion 69*b* of upper surface 69 is generally horizontal and abuts a lower surface of bracket 36 when latch 26 is in the latched position shown in FIG. 4. The tab 70 extends upward from and is joined to lower surface 68 and upper surface 69. Tab 70 is oriented generally vertically when latch 26 is in the latched position as shown in FIG. 2. When latch 26 is in the latched position, tab 70 extends through the slot (not shown) in bracket 36 between tabs 44*a* and 44*b*.

Tab 70 includes an opening (not shown) that is aligned with the openings in tabs 44*a* and 44*b* when latch 26 is in the latched position. The aligned openings in tabs 44*a*, 44*b* and 70 are designed to receive a seal 71, shown in FIG. 2. The seal 71 is a wire that is threaded through the openings in tabs 44*a*, 44*b*, and 70 after the railcar 10 is filled with cargo, cover 16 is closed, and latch 26 is moved to the latched position. The seal 71 is broken as latch 26 is moved to the unlatched position, shown in FIG. 5. The seal 71 serves as an indicator of whether cover 16 has been opened, which may mean that the cargo within railcar 10 has been tampered with or contaminated. While seal 71 is shown as a wire, any type of seal is within the scope of the present invention. For instance, the seal may be a pop rivet that is designed for insertion through the tabs 44*a*, 44*b*, and 70 with a rivet gun and is designed to break when the latch 26 is moved to the unlatched position.

Figure 6:
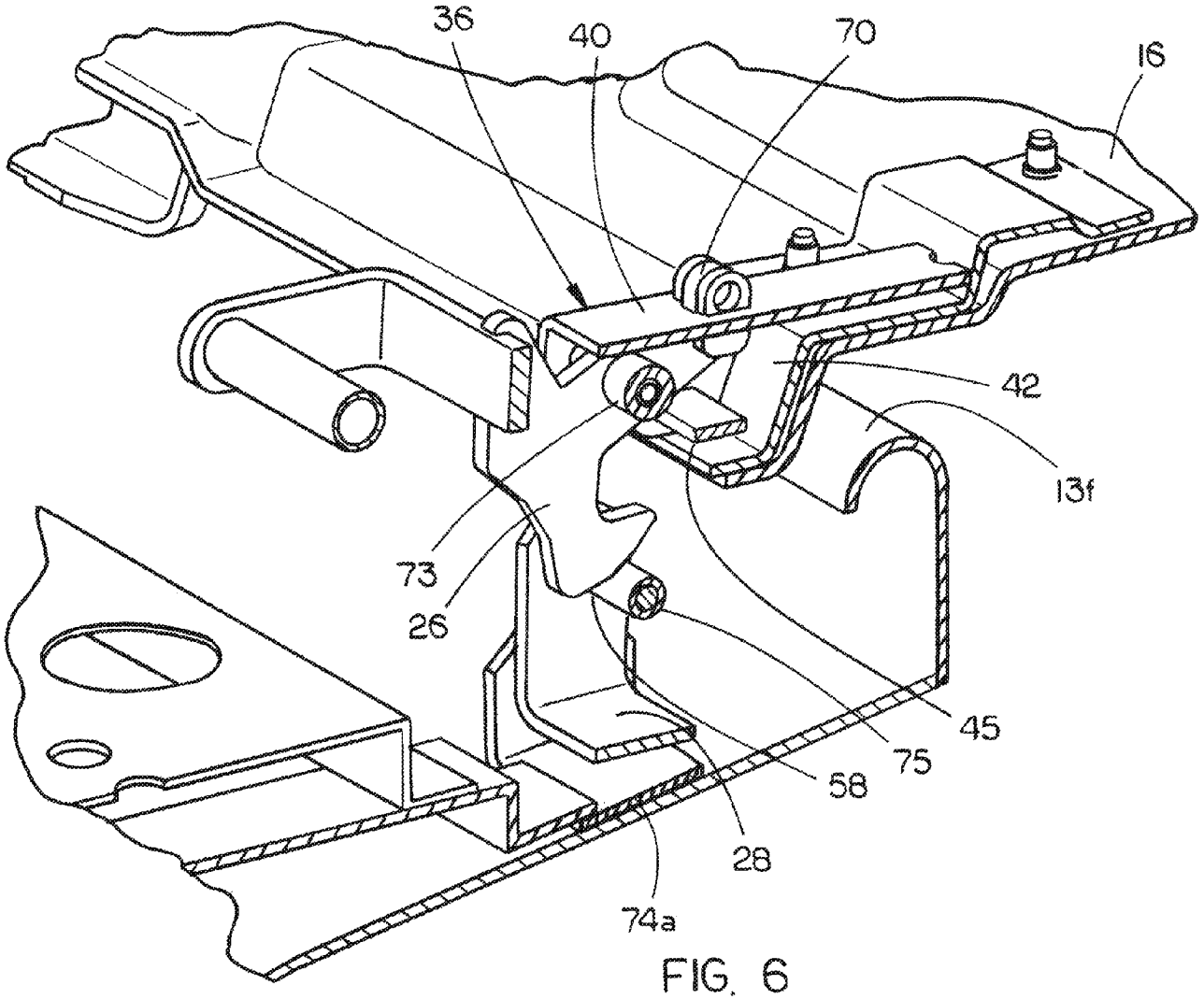
FIG. 6 is a cross-sectional perspective view of a portion of the railcar hatch cover assembly of FIG. 2 showing the latch in the unlatched position and the cover partially open.

Referring to FIG. 4, rotating arm 54 includes an opening 72 that receives bolt 32 for rotatably mounting latch 26 to bracket 36 and cover 16. As shown in FIG. 6, a cylindrical spacer 73 is positioned between one side of latch 26 and bracket 36. Another cylindrical spacer (not shown) is positioned between the opposite side of latch 26 and bracket 36. The spacers 73 have openings that receive bolt 32. The spacers 73 center latch 26 between the opposite sides of U-shaped section 40 to substantially restrain latch 26 from moving in a direction aligned with the longitudinal axis of bolt 32.

Latch engaging structure 28, shown in FIG. 3, includes a U-shaped mounting bracket 74, U-shaped base bracket 74*a*, and a generally horizontal bar 75. Mounting bracket 74 includes generally vertical plates 76*a* and 76*b* and a generally horizontal plate 78, and base bracket 74*a* includes similar generally vertical plates and a generally horizontal plate. Mounting bracket 74 is positioned between the vertical plates of base bracket 74*a*. Mounting bracket 74 is also joined to base bracket 74*a*, which is mounted, and preferably welded, to the top 13*e* (FIG. 1) of railcar 10. Horizontal bar 75 extends between vertical plates 76*a* and 76*b*, is spaced above top 13*e* of railcar 10, and is aligned with the longitudinal axis of railcar 10. A bolt 80 extends through aligned openings in vertical plates 76*a* and 76*b* and horizontal bar 75 for joining horizontal bar 75 to mounting bracket 74. A nut 82 engages threads on bolt 80. Mounting bracket 74 may be secured to base bracket 74*a*, and base bracket 74*a* may be joined to railcar 10, with one or more fasteners, an adhesive, via welding, or any other means known in the art. Vertical plates 76*a* and 76*b* are preferably formed integrally with horizontal mounting plate 78 such that mounting bracket 74 is of singular construction. When latch 26 is in the latched position shown in FIG. 4, the upper surface 56 of latch 26 engages bar 75 for preventing vertical movement of cover 16 as the railcar 10 moves and preventing access to the interior of railcar 10 through opening 13*f*.

Covers 14*a-d* may each include a railcar latch assembly that is similar to the railcar latch assembly 18 described above in connection with hatch cover assembly 12*a*. Alternatively, each of covers 14*a-d* may include a handle, similar to handle 24 described above, that is mounted to the top surface of the cover adjacent the cover's edge and not include the rotating latch 26 and corresponding latch engaging structure 28 of the railcar latch assembly 18 described above.

Figure 8:
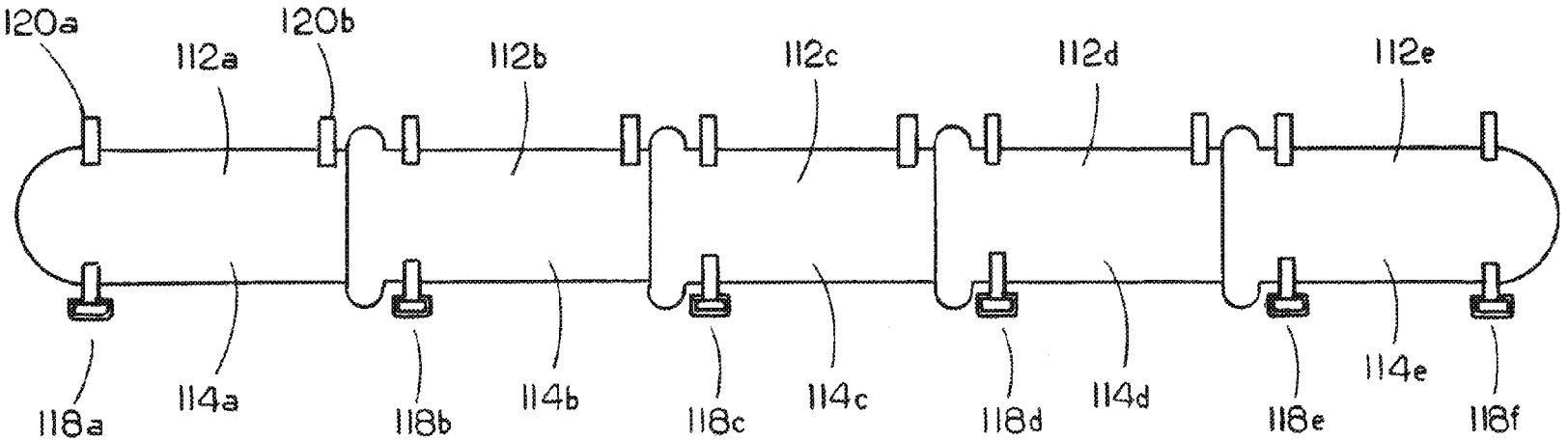
FIG. 8 is a schematic view of five overlapping railcar hatch cover assemblies in accordance with an alternative embodiment of the present invention.

FIG. 8 shows schematically five railcar hatch cover assemblies in accordance with a second exemplary embodiment of the present invention that are generally identified as 112*a*, 112*b*, 112*c*, 112*d*, and 112*e*. Railcar hatch cover assemblies 112*a-e* may be used with a railcar such as railcar 10 shown in FIG. 1 in lieu of hatch cover assemblies 12*a-e* and covers 14*a-d*. Each of railcar hatch cover assemblies 112*a-e* has a respective cover 114*a-e* as well as a respective railcar latch assembly 118*a-e*. Each of railcar latch assemblies 118*a-e* is secured at the left-hand side of its respective cover 114*a*, 114*b*, 114*c*, 114*d*, and 114*e* when viewed as shown in FIG. 8. Another railcar latch assembly 118*f* is secured at the right-hand side of cover 114*e* when viewed as shown in FIG. 8. Each of railcar latch assemblies 118*a-f* is preferably substantially identical to railcar latch assembly 18 shown in FIG. 2 and described above. Cover 114*e* partially overlaps cover 114*d*; cover 114*d* partially overlaps cover 114*c*; cover 114*c* partially overlaps cover 114*b*; and cover 114*b* partially overlaps cover 114*a*. Because the covers 114*a-e* overlap in this manner, the covers 114*a-e* must be opened in the following order: cover 114*e*, cover 114*d*, cover 114*c*, cover 114*b*, and cover 114*a*. Each of railcar latch assemblies 118*a-f* has a latch that may be latched and unlatched in the same way as railcar latch assembly 18 described above. Cover 114*a* is mounted to a railcar with hinges 120*a* and 120*b* and is rotatable from the closed position shown in FIG. 8 approximately 180 degrees to an open position in a similar manner as cover 16 described above. Covers 114*b-e* are mounted to a railcar with hinges and rotatable in a similar manner as cover 114*a*.

Figure 9:
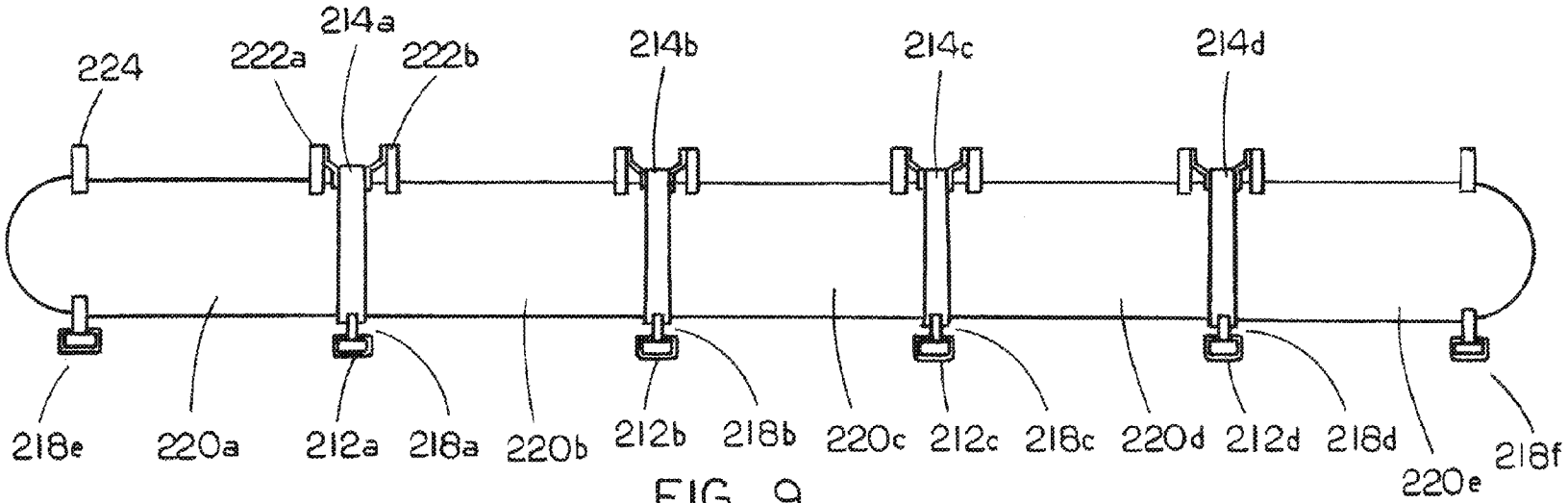
FIG. 9 is a schematic view of four railcar hatch cover assemblies in accordance with an alternative embodiment of the present invention, wherein each hatch cover assembly includes a batten bar partially overlapping adjacent railcar covers.

Referring to FIG. 9, four railcar hatch cover assemblies in accordance with a third exemplary embodiment of the present invention are generally identified as 212*a*, 212*b*, 212*c*, and 212*d*. Each of railcar hatch cover assemblies 212*a-d* includes a respective batten bar 214*a-d* as well as a respective railcar latch assembly 218*a-d*. Railcar hatch cover assemblies 212*a-d* are operable to secure five covers 220*a-e* in a closed position to the top of a railcar. Railcar hatch cover assemblies 212*a-d* and covers 220*a-e* may be used with a railcar such as railcar 10 shown in FIG. 1 in lieu of hatch cover assemblies 12*a-e* and covers 14*a-d*. Cover 220*a* includes a railcar latch assembly 218*e* on its left end, when viewed as shown in FIG. 9, and cover 220*e* includes a railcar latch assembly 218*f* on its right end. Railcar latch assemblies 218*a-f* are substantially identical to railcar latch assembly 18 described above. In a closed position, each batten bar 214*a-d* overlaps the adjacent edges of two covers 220*a-e* such that batten bar 214*a* overlaps the adjacent edges of covers 220*a* and 220*b*, batten bar 214*b* overlaps the adjacent edges of covers 220*b* and 220*c*, batten bar 214*c* overlaps the adjacent edges of covers 220*c* and 220*d*, and batten bar 214*d* overlaps the adjacent edges of covers 220*d* and 220*e*.

Each of railcar latch assemblies 218*a-f* has a latch that may be latched and unlatched in the same way as railcar latch assembly 18 described above. Batten bar 214*a* is mounted to a railcar with hinges 222*a* and 222*b* and is rotatable from the closed position shown in FIG. 9 approximately 180 degrees to an open position. Batten bars 214*b-d* are mounted to a railcar with hinges and rotatable in a similar manner as batten bar 214*a*. Cover 220*a* is mounted to a railcar with a hinge 224 and hinge 222*a*. Thus, hinge 222*a* mounts both cover 220*a* and batten bar 214*a* to the railcar, and hinge 222*b* mounts both cover 220*b* and batten bar 214*a* to the railcar. Cover 220*a* is rotatable from the closed position shown in FIG. 9 approximately 180 degrees to an open position after batten bar 214*a* is moved to its open position. Covers 220*b-e* are likewise rotatable from the closed position shown in FIG. 9 to an open position after the respective batten bars 214*a-d* overlapping the edges of the covers 220*b-e* are moved to their open position.

Figure 10:
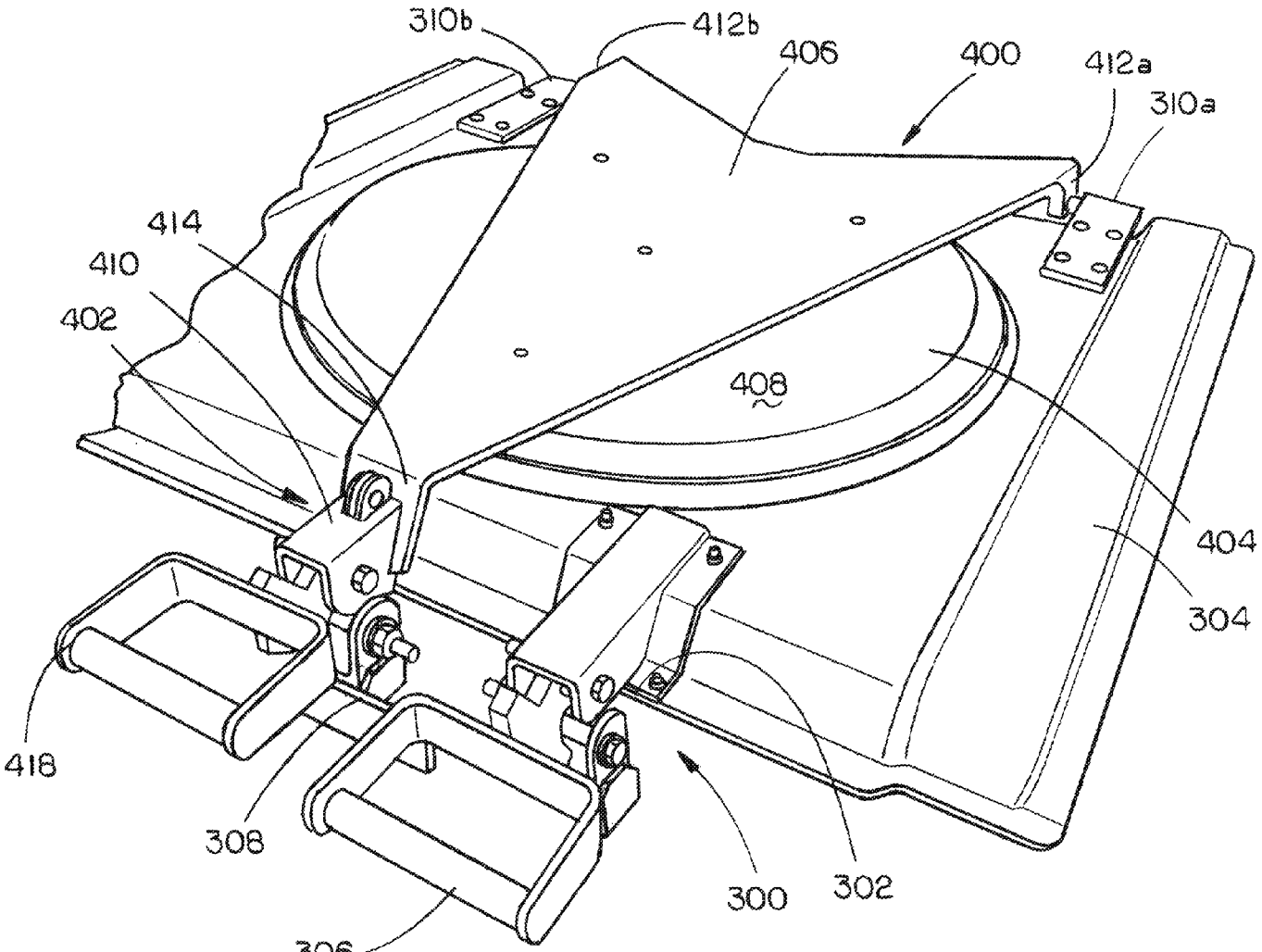
FIG. 10 is a perspective view of another alternative embodiment of railcar hatch cover assembly of the present invention, which includes a cover having a port opening and a port cover covering the port opening.

Looking to FIG. 10, an alternative embodiment of railcar hatch cover assembly in accordance with the present invention is identified generally as 300. Railcar hatch cover assembly 300 is substantially similar to the railcar hatch cover assembly 12*a* shown in FIG. 1 except that it includes a port opening (not shown) covered by another railcar hatch cover assembly 400. Railcar hatch cover assembly 300 may be substituted for railcar hatch cover assembly 12*a* shown in FIG. 1 such that it is operable to partially overlap two adjacent covers when in a closed position.

Railcar hatch cover assembly 300 includes a railcar latch assembly 302 and a cover 304. Railcar latch assembly 302 is substantially similar to railcar latch assembly 18 shown in FIG. 2 except that it is mounted to cover 304 in a position that is offset from the center of cover 304 in order to accommodate hatch cover assembly 400. Railcar latch assembly 302 also does not include the tabs 44*a-b* and 70 shown in FIG. 2. However, it is within the scope of the invention for the railcar latch assembly 302 to include tabs similar to those shown in FIG. 2. A handle 306 of railcar latch assembly 302 further includes an activation bar 308 that extends outward from the handle 306 toward railcar hatch cover assembly 400. Railcar latch assembly 302 has a latch that may be latched and unlatched in the same manner as railcar latch assembly 18 described above. Cover 304 mounts to a railcar, such as railcar 10 shown in FIG. 1, with a pair of hinges 310*a* and 310*b*. Cover 304 is rotatable between the closed position shown in FIG. 10 approximately 180 degrees to an open position permitting access to the interior of the railcar on which is it mounted.

Railcar hatch cover assembly 400 includes a railcar latch assembly 402 and a port cover 404. Railcar latch assembly 402 is substantially identical to railcar latch assembly 18 shown in FIG. 2. Port cover 404 includes a triangular panel 406 to which is joined a circular cover 408 and a bracket 410 of railcar latch assembly 402. Panel 406 includes hinge connectors 412*a* and 412*b* that rotatably join port cover 404 to hinges 310*a* and 310*b*, respectively. Bracket 410 is joined to a downwardly extending lip 414 of panel 406. Bracket 410 is similar to bracket 36 shown in FIG. 2 but is shorter. Panel 406 increases in width from lip 414 to hinge connectors 412*a* and 412*b*. Hinge connectors 412*a* and 412*b* extend downward from the rear sides of the back of panel 406 to where they are rotatably mounted to hinges 310*a* and 310*b*. The back edge of panel 406 that extends between hinge connectors 412*a* and 412*b* is curved inwardly towards the front of railcar hatch cover assembly 400.

Railcar latch assembly 402 has a latch that may be latched and unlatched in the same manner as railcar latch assembly 18 described above. Port cover 404 is rotatable between the closed position shown in FIG. 10, in which it covers a port opening (not shown) in cover 304, approximately 180 degrees to an open position permitting access to the interior of the railcar on which is it mounted through the port opening in cover 304. Railcar latch assembly 402 may be unlatched and port cover 404 may be opened without unlatching railcar latch assembly 302 and opening cover 304. When railcar latch assembly 302 is unlatched, activation bar 308 engages a handle 418 of railcar latch assembly 402 to simultaneously unlatch railcar latch assembly 402. When railcar latch assemblies 302 and 402 are unlatched, cover 304 may be moved from its closed position to its open position. Because railcar latch assembly 402 must be unlatched in order to open cover 304 and port cover 404, it is only necessary to use a seal, similar to the seal 71 shown in FIG. 2, with the railcar latch assembly 402.

In operation, in order to open railcar hatch cover assembly 12*a* and access the interior of railcar 10, shown in FIG. 1, an operator standing on walkway 23*a* grasps bar 46 of handle 24 (FIG. 2) with his/her hand. The operator then applies a substantially vertical force directed upward to handle 24. The vertical force rotates latch 26 upward from the latched position shown in FIG. 4 to the unlatched position shown in FIG. 5. The rotation is in a clockwise direction when viewed as shown in FIG. 5. As latch 26 rotates, tab 70 rotates through the slot in bracket 36 between tabs 44*a-b* and shears seal 71, shown in FIG. 2. If latch 26 is rotated beyond the position shown in FIG. 5, it will contact stop plate 45 to prevent over-rotation beyond the unlatched position. First portion 69*a* of upper surface 69 (FIG. 5) may also contact the underside of bracket 36 to prevent over-rotation of latch 26 beyond the unlatched position.

After latch 26 has been rotated to the unlatched position shown in FIG. 5, the continued application of vertical force to handle 24 rotates cover 16 from the closed position shown in FIGS. 4 and 5 to the partially open position shown in FIG. 6, and further application of force to handle 24 rotates cover 16 to a fully open position in which a top surface of cover 16 abuts walkway 23*b* (FIG. 1). A single movement shears seal 71, unlatches latch 26 and opens cover 16. Cover 16 rotates approximately 180 degrees between the closed position shown in FIG. 4 and a fully open position. The rotation is in the clockwise direction when viewed as shown in FIG. 5. When cover 16 is in the open position, the interior of railcar 10 may be accessed through opening 13*f*. Railcar hatch cover assembly 12*e* opens in a similar manner as described above with respect to railcar hatch cover assembly 12*a*. After cover 16 and the cover of hatch cover assembly 12*e* are opened, cover 14*a* may be opened by rotating it approximately 180 degrees from the position shown in FIG. 1 to a position in which it abuts walkway 23*b*. Railcar hatch cover assemblies 12*b-d* open in a similar manner as described above with respect to railcar hatch cover assembly 12*a*. Once the covers of railcar hatch cover assemblies 12*b-d* are opened, covers 14*b-d* may also be opened in a similar manner as cover 14*a* by lifting on the edge of each cover. As described above, covers 14*a-d* may each include a handle similar to handle 24 to facilitate opening of the covers 14*a-d*.

When it is desired to cover the opening 13*f* in railcar 10, covers 14*a-d* are first rotated to the closed position by an operator on walkway 23*b* (FIG. 1). Covers 14*a-d* are grasped by the operator and rotated away from walkway 23*b* until they cover opening 13*f*. The operator then moves cover 16 from its open position to its closed position by grasping cover 16 and rotating it upward away from walkway 23*b*. When the cover 16 is rotated slightly more than 90 degrees so that it has been rotated just past a vertical position, the operator may let go of the cover 16 so that gravity causes the cover 16 to fall over opening 13*f*. As the cover 16 falls, it eventually moves into the position shown in FIG. 6, in which the latch 26 is positioned above latch engaging structure 28. The arcuate bottom surface 58 of latch 26 engages bar 75 of latch engaging structure 28. Arcuate bottom surface 58 is shaped so that as it engages bar 75 and cover 16 moves downward as a result of gravity or the application of force by an operator, bar 75 causes latch 26 to rotate upward to the unlatched position shown in FIG. 5, in which bottom surface 58 clears bar 75. As the cover 16 reaches the closed position covering opening 13*f* and bottom surface 58 clears bar 75, latch 26 automatically rotates downward from the unlatched position shown in FIG. 5 to the latched position shown in FIG. 4. The weight of handle and latch assembly 30 is balanced so that latch 26 remains in the latched position and does not bounce back upward to the unlatched position. Thus, after the operator drops cover 16, the cover 16 automatically moves to the closed position and the latch 26 automatically moves to the latched position. Occasionally, after the cover 16 is dropped, the operator may need to assist in moving latch 26 to the latched position.

When latch 26 is in the latched position, seal 71 (FIG. 2) may be inserted through the aligned openings in tabs 44*a-b* and 70. Instead of dropping cover 16 to the closed position, the operator may continue to hold the cover 16 while guiding it to the closed position and manually rotate the latch 26 from the unlatched position to the latched position. Railcar hatch cover assemblies 12*b-e* are closed in the same manner described above with respect to railcar hatch cover assembly 12*a*.

Railcar hatch cover assemblies 112*a-e* shown in FIG. 8 and railcar hatch cover assemblies 212*a-d* operate in a similar manner as described above with respect to hatch cover assembly 12*a*. Each is unlatched and opened by an operator grasping a handle and applying a substantially vertical force to the handle. Each is closed and latched by dropping the cover from an open position to a closed position. As described above, railcar hatch cover assemblies 112*a-e* must be opened in the following sequence 114*e*, 114*d*, 114*c*, 114*b*, and 114*a* and closed in a reverse sequence. Railcar hatch cover assemblies 214*a-d* must be opened prior to opening covers 220*a-e*.

Railcar hatch cover assembly 300 shown in FIG. 10 operates in a similar manner as railcar hatch cover assembly 12*a* described above, except that when railcar latch assembly 302 is unlatched, activation bar 308 simultaneously unlatches railcar latch assembly 402. Railcar hatch cover assembly 400 operates in a similar manner as railcar hatch cover assembly 12*a* described above.

From the foregoing it will be seen that this invention is one well adapted to attain all ends and objectives hereinabove set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. A railcar hatch cover assembly comprising:

a cover adapted to be mounted to a railcar for movement between a closed position and an open position;

a latch engaging structure adapted to be mounted to the railcar; and a handle and latch assembly rotatably mounted to the cover at a pivot axis, wherein the handle and latch assembly comprises:

a latch that is moveable between a latched position, in which the latch engages the latch engaging structure, and an unlatched position, in which the latch engages the cover to prevent further rotation of the latch beyond the unlatched position; and a handle coupled to the latch, wherein the handle comprises a bar that is spaced from the latch and is configured to be grasped by an operator, wherein the handle extends laterally from the pivot axis and is substantially horizontal when the latch is in the latched position, wherein the handle moves the latch from the latched position to the unlatched position when a substantially vertical force directed upward is applied to the bar, wherein the handle moves the cover from the closed position to the open position when the substantially vertical force directed upward is applied to the bar and the latch engages the cover, and wherein when the cover is dropped from the open position to the closed position, the latch contacts the latch engaging structure and moves from the unlatched position to the latched position.

2. The railcar hatch cover assembly of claim 1, wherein said cover is selected from the group consisting of a port cover and a batten bar.

3. The railcar hatch cover assembly of claim 1, wherein said latch engaging structure comprises a pair of generally vertical plates, and a generally horizontal bar that is coupled with each of the plates and extends between the plates such that the bar is spaced above the railcar and the bar is aligned with a longitudinal axis of the railcar.

4. The railcar hatch cover assembly of claim 1, wherein the handle and latch assembly rotates upward when the latch moves from the latched position to the unlatched position, and wherein the handle and latch assembly rotates downward when the latch moves from the unlatched position to the latched position.

5. The railcar hatch cover assembly of claim 4, wherein said latch comprises a substantially planar upper surface that engages said latch engaging structure when said latch is in the latched position, and wherein said latch comprises an arcuate bottom surface that contacts the latch engaging structure when the cover is dropped from the open position to the closed position and causes said handle and latch assembly to rotate upward.

6. The railcar hatch cover assembly of claim 5, wherein said latch engaging structure is positioned below said pivot axis when said latch is in the latched position.

7. The railcar hatch cover assembly of claim 6, wherein said bar is generally parallel to said pivot axis.

8. The railcar hatch cover assembly of claim 7, wherein said handle comprises a D shape.

9. The railcar hatch cover assembly of claim 1, further comprising a first tab coupled to the cover, wherein the first tab comprises a first opening, and a second tab coupled to the latch, wherein the second tab comprises a second opening, wherein when said latch is in the latched position, said first and second openings are aligned such that a seal may be threaded through the aligned first and second openings.

10. The railcar hatch cover assembly of claim 9, wherein moving said latch from the latched position to the unlatched position shears the seal.

11. The railcar hatch cover assembly of claim 1, wherein the cover comprises a bracket, and wherein the latch engages the bracket when in the unlatched position to prevent further movement of the latch beyond the unlatched position.

12. A railcar latch assembly comprising:

a latch engaging structure adapted to be mounted to a railcar;

a bracket adapted to be mounted to a cover of the railcar; and a handle and latch assembly adapted to be rotatably mounted to the bracket at a pivot axis, wherein the handle and latch assembly comprises:

a latch comprising an upper surface and an arcuate bottom surface, wherein the latch is moveable between a latched position, in which the upper surface engages the latch engaging structure, and an unlatched position, in which the latch engages the bracket to prevent further rotation of the latch beyond the unlatched position, and wherein the arcuate bottom surface contacts the latch engaging structure to move the latch from the unlatched position to the latched position; and a handle coupled to the latch, wherein the handle comprises a bar that is spaced from the latch and is configured to be grasped by an operator, wherein the handle extends laterally from the pivot axis and is substantially horizontal when the latch is in the latched position, wherein the handle moves the latch from the latched position to the unlatched position when a substantially vertical force directed upward is applied to the bar, and wherein the handle is operable to open the cover when the substantially vertical force directed upward is applied to the bar and the latch engages the bracket.

13. The railcar latch assembly of claim 12, wherein said latch engaging structure comprises a pair of generally vertical plates, and a generally horizontal bar that is coupled with each of the plates and extends between the plates such that the bar is spaced above the railcar and the bar is aligned with a longitudinal axis of the railcar.

14. The railcar latch assembly of claim 12, wherein the handle and latch assembly rotates upward when the latch moves from the latched position to the unlatched position, and wherein the handle and latch assembly rotates downward when the latch moves from the unlatched position to the latched position.

15. The railcar latch assembly of claim 12, wherein said handle comprises a rectangular or D shape.

16. The railcar latch assembly of claim 12, further comprising a first tab adapted to be coupled to the cover, wherein the first tab comprises a first opening, and a second tab coupled to the latch, wherein the second tab comprises a second opening, wherein when said latch is in the latched position, said first and second openings are aligned such that a seal may be threaded through the aligned first and second openings.

17. The railcar latch assembly of claim 16, wherein moving said latch from the latched position to the unlatched position shears the seal.

* * * * *